US011556092B2

(12) United States Patent
Bachmann et al.

(10) Patent No.: US 11,556,092 B2
(45) Date of Patent: Jan. 17, 2023

(54) HOROLOGICAL MOBILE COMPONENT WITH ELEMENT MAINTAINED BY FRICTION

(71) Applicant: ETA SA Manufacture Horlogère Suisse, Grenchen (CH)

(72) Inventors: Stéphane Bachmann, Büren an der Aare (CH); Christophe Cattin, Le Noirmont (CH); Yves-Alain Cosandier, Renens (CH); Laurent Kaelin, Sonvilier (CH)

(73) Assignee: ETA SA Manufacture Horlogère Suisse, Grenchen (CH)

( * ) Notice: Subject to any disclaimer, the term of this patent is extended or adjusted under 35 U.S.C. 154(b) by 312 days.

(21) Appl. No.: 17/027,851

(22) Filed: Sep. 22, 2020

(65) Prior Publication Data

US 2021/0157275 A1 May 27, 2021

(30) Foreign Application Priority Data

Nov. 21, 2019 (EP) ..... 19210647

(51) Int. Cl.
*G04B 13/02* (2006.01)
*G04B 31/00* (2006.01)

(52) U.S. Cl.
CPC ..... *G04B 31/00* (2013.01); *G04B 13/02* (2013.01)

(58) Field of Classification Search
CPC ..... G04B 13/028; G04B 31/00; G04B 13/02; G04B 13/023; F16H 55/32; F16H 55/40
See application file for complete search history.

(56) References Cited

U.S. PATENT DOCUMENTS 417,644 A 12/1889 Hunter
900,380 A 10/1908 Jost
(Continued)

FOREIGN PATENT DOCUMENTS

CH 701 651 B1 2/2011
CH 708 965 A2 6/2015
(Continued)

OTHER PUBLICATIONS

European Search Report dated May 13, 2020 in European Application 19210647.4 filed Nov. 21, 2019 (with English Translation of Categories of Cited Documents), 3 pages.
(Continued)

*Primary Examiner* — Sean Kayes
(74) *Attorney, Agent, or Firm* — Oblon, McClelland, Maier & Neustadt, L.L.P.

(57) ABSTRACT

A horological mobile component, including around an axis, a first element including a first shoulder and a second element including a second shoulder which cooperates by friction with a third shoulder that is included by a third element interposed between the first element and the second element, this third element includes a fourth shoulder cooperating by friction with the first shoulder or being driven onto this first shoulder, and the diameter of the third shoulder is at least double the diameter of the fourth shoulder, and the second element includes a main hollow defining at least two bearing surfaces each including one or two bearing sectors belonging to the second shoulder.

23 Claims, 3 Drawing Sheets

(56) References Cited

U.S. PATENT DOCUMENTS 1,076,605 A * 10/1913 Reston ..... F16H 55/40 474/903
1,143,012 A * 6/1915 Zahniser ..... F16H 55/40 474/195
1,333,131 A * 3/1920 Pieper ..... F16H 55/40 464/41
2,952,118 A 9/1960 Rueger
3,443,375 A * 5/1969 Cielaszyk ..... G04B 19/02 368/323
3,487,633 A * 1/1970 Wuthrich ..... G04B 11/003 368/185
4,408,898 A * 10/1983 Vuilleumier ..... G04B 19/02 968/293
5,155,712 A * 10/1992 Mose ..... G04B 11/001 368/220
7,651,259 B2 * 1/2010 Garrard ..... G04B 19/283 368/190
8,274,864 B2 * 9/2012 Ono ..... G04B 11/003 464/30
10,303,121 B2 * 5/2019 Fukuda ..... G04B 13/02
10,365,608 B2 * 7/2019 Mertenat ..... G04B 13/021
2006/0187768 A1 * 8/2006 Murazumi ..... G04B 13/023 368/324
2010/0238771 A1 * 9/2010 Verardo ..... G04B 13/02 368/322
2010/0238772 A1 * 9/2010 Verardo ..... G04B 13/021 368/324
2014/0313869 A1 10/2014 Cattiau
2016/0026154 A1 * 1/2016 Courvoisier ..... G04B 13/022 368/184
2019/0186611 A1 * 6/2019 Kinoshita ..... F16H 55/40

FOREIGN PATENT DOCUMENTS

CN 103123455 A 5/2013
CN 106873346 A 6/2017
EP 2 796 940 A2 10/2014

OTHER PUBLICATIONS

Combined Chinese Office Action and Search Report dated Sep. 2, 2021 in Patent Application No. 202011309951.9 (with English translation of Category of Cited Documents), 8 pages.

* cited by examiner

HOROLOGICAL MOBILE COMPONENT WITH ELEMENT MAINTAINED BY FRICTION

CROSS-REFERENCE TO RELATED APPLICATION

This application claims priority to European Patent Application No. 19210647.4 filed on Nov. 21, 2019, the entire disclosure of which is hereby incorporated herein by reference.

FIELD OF THE INVENTION

The invention relates to an horological mobile component with an element maintained by friction, including a first element including a first shoulder around an axis, and a second element including a second shoulder around said axis.

The invention also relates to an adjustable display mechanism, including at least one such mobile component.

The invention also relates to an horological movement including at least one such adjustable display mechanism, and/or at least one such mobile component.

The invention also relates to a timepiece, in particular a watch, including at least one such movement, and/or at least one such adjustable display mechanism, and/or such a mobile component.

The invention relates to the setting or adjustment mechanisms for display mechanisms or to horological movements.

BACKGROUND OF THE INVENTION

Friction devices are routinely used in horology for mechanisms for correcting display, such as setting, or other. These devices have a certain number of well-known disadvantages:

- poor stability of the friction, and poor control of the friction, in particular in mechanisms with small dimensions, which affects the sensitivity of the system;
- the mounting interface is often unfavourable, when this friction relates to the usual case of bearing of a plate on a hub, and problems can be related to the presence of burrs, to the flatness defect of the plate, to a deformation of the plate, or other, which manifests itself as irregular and non-reproducible phenomena and, in the worst case, by a pollution of the horological movement by detachable particles;
- the case of a functional friction on a small diameter is always more complicated, because of low friction, and a greater dispersion than in mechanisms with larger dimensions, for which the geometric constraints are lesser and in which the values of friction torque can be much higher than those of the other rubbing torques in the movement. These small diameters are very common in women's watches, and of course in miniature movements, but they are not rare in the other watches, since designers make themselves limit the volume taken up inside a movement by such friction adjustments.

The document U.S. Pat. No. 417,644 on behalf of HUNTER describes a snap-on cannon-pinion and a sleeve arranged for its fastening onto an arbor, which are arranged to cooperate through an elastic link.

SUMMARY OF THE INVENTION

The invention proposes developing a friction mechanism overcoming the disadvantages of the prior art, in particular for the case of small diameters, and in such a way as to allow good resistance, and capabilities for precise adjustment, to facilitate the pairing of the components, to facilitate the assembly, while preserving a moderate manufacturing cost, and while eliminating the risk of dissemination of burrs or of chips in the horological movement. To do this, the invention creates the friction on a diameter greater than that which is known, and this friction occurs in particular between a plate and an intermediate component that allows adjustment.

For this purpose, the invention relates to an horological mobile component with an element maintained by friction, according to claim 1.

The invention also relates to an adjustable display mechanism, including at least one such mobile component.

The invention also relates to an horological movement including at least one such adjustable display mechanism, and/or at least one such mobile component.

The invention also relates to a timepiece, in particular a watch, including at least one such movement, and/or at least one such adjustable display mechanism, and/or such a mobile component.

BRIEF DESCRIPTION OF THE DRAWINGS

Other features and advantages of the invention will appear upon reading the following detailed description, in reference to the appended drawings, in which:

in FIG. 3, the second internal shoulder and the third external shoulder are both cylindrical;

in FIG. 4, the second internal shoulder and the third external shoulder are both conical;

in FIG. 5, the second internal shoulder is cylindrical and the third external shoulder is conical;

DETAILED DESCRIPTION OF THE PREFERRED EMBODIMENTS

Figure 1:
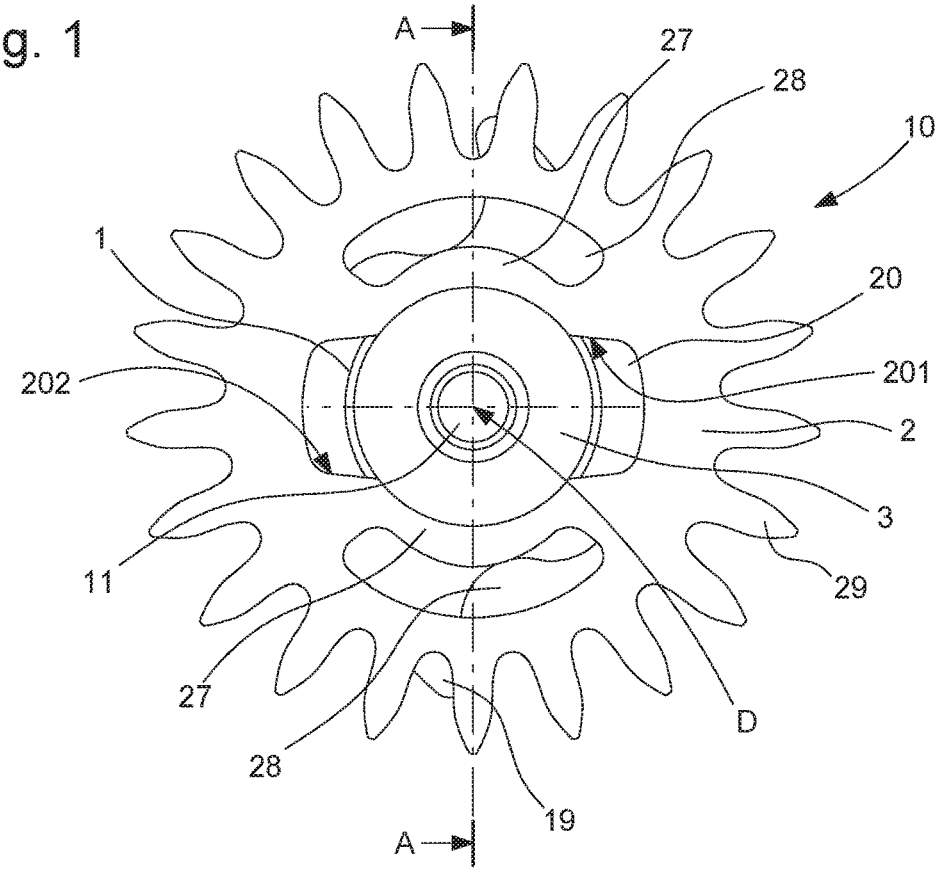
FIG. 1 shows, in a schematised manner, and in a bottom view, an horological mobile component, which includes a first element, and which includes a second element maintained by friction, according to the invention; a trunnion that the first element includes is visible in the central part; this trunnion is inserted into a third element, which is interposed between the first element and the second element, and which cooperates by friction with the second element consisting here of a plate provided with a toothing in this non-limiting particular case; this plate includes a main hollow, and secondary hollows, which define flexible arms that this second element includes, which flexible arms squeeze with friction a shoulder of the third element; through these hollows, first drive means, here fingers, that the first element includes are visible.
Figure 2:
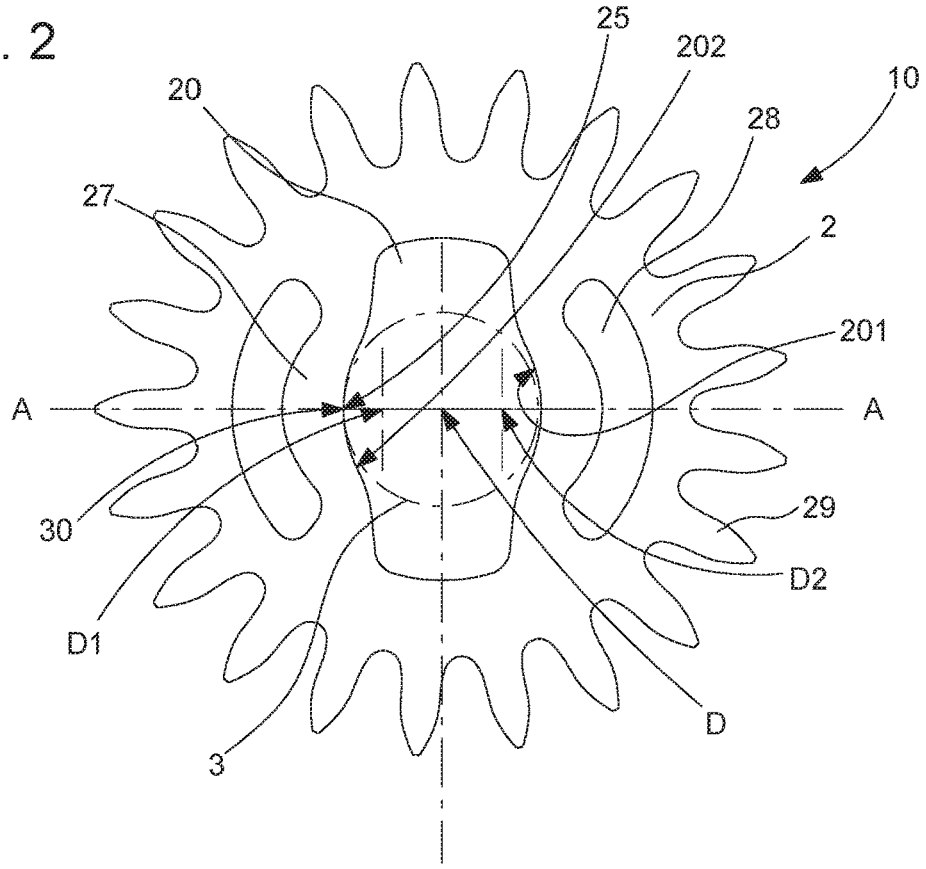
FIG. 2 shows, in a schematised manner and in a cross-section in a plane perpendicular to the axis, the same horological mobile component at the friction, which is here a friction of the two-point type, between the second element and the third element; the flexible arms of the second element include bearing surfaces off-centre with respect to the main axis.
Figure 3:
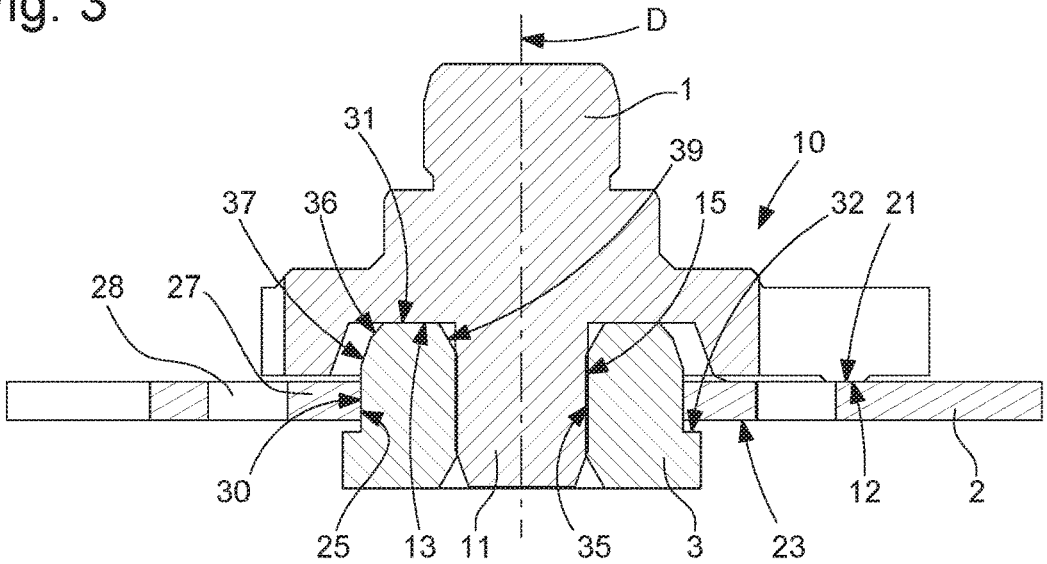
FIGS. 3 to 5 show, in a schematised manner in a cross-section according to the cutting plane AA of FIGS. 1 and 2 and passing through the main axis, three alternative embodiments, non-limiting, relative to the geometry of a second internal shoulder of the second element and of a third external shoulder of the third element, at the interface of which the friction occurs.

The invention relates to an horological mobile component 10 with an element maintained by friction. This mobile component 10 includes a first element 1, which includes a first shoulder 15, in particular at a trunnion 11, around an axis D, and a second element 2, which includes a second shoulder 25 around the axis D.

According to the invention, the second shoulder 25 of the second element 2 cooperates by friction with a third shoulder 30 that is included, around the axis D, by a third element 3. This third element 3 is interposed between the first element 1 and the second element 2, and this third element 3 includes a fourth shoulder 35. This fourth shoulder 35 cooperates by friction with the first shoulder 15, or is fastened onto the first shoulder 15. And the minimum bearing diameter, with respect to the axis D, of the third shoulder 30 is at least double the maximum bearing diameter of the fourth shoulder 35.

In one alternative, the fourth shoulder 35 cooperates by friction with the first shoulder 15. More particularly, the friction torque between the fourth shoulder 35 and the first shoulder 15 is thus greater than the friction torque between the second shoulder 25 and the third shoulder 30.

In another alternative, the fourth shoulder 35 is driven onto the first shoulder 15. More particularly, the fourth shoulder 35 is stopped on the first shoulder 15 by at least one weld point.

More particularly, the first element 1 includes a first stop bearing surface 12, which is arranged to cooperate via axial stop bearing, according to the direction of the axis D, with a second stop bearing surface 21 that the second element 2 includes.

More particularly, the first element 1 includes an inner stop bearing surface 13, which is arranged to cooperate via axial stop bearing, according to the direction of the axis D, with a complementary inner stop bearing surface 31 that the third element 3 includes.

More particularly, the third element 3 includes an outer stop bearing surface 32, which is arranged to cooperate with a complementary outer stop bearing surface 23 that the second element includes to limit their relative axial travel according to the direction of the axis D. More particularly, the space between the outer stop bearing surface 32 and the complementary outer stop bearing surface 23 is arranged to allow the introduction of a thickness gauge to adjust the value of the gripping between the third element 3 and the second element 2 and thus the value of the friction exerted by the second element 2 on the third element 3. Thus the friction is adjustable according to the driving height.

More particularly, the first element 1 includes at least first drive means 19, and/or the second element 2 includes at least second drive means 29.

According to the invention, the second element 2 includes a main hollow 20 defining at least two bearing surfaces 201, 202, each including one or two bearing sectors belonging to the second shoulder 25. Even more particularly, this main hollow 20 defines two bearing surfaces 201, 202, each including two bearing sectors belonging to the second shoulder 25, and the main hollow 20 is countersunk between the bearing sectors, for a bearing limited to four points between the first element 1 and the second element 2.

More particularly, the second element 2 exerts a friction on the third element 3 by flexible arms 27, which are disposed between the main hollow 20 and the secondary hollows 28.

More particularly, the third element 3 includes at least one insertion surface 36, 37, 38, 39, which is conical or spherical, or similar, for its insertion onto the first element 1 or into the second element 2.

More particularly, the fourth shoulder 35 and the first shoulder 15 are of revolution about the axis D. Even more particularly, the fourth shoulder 35 and the first shoulder 15 are cylindrical around the axis D.

In one alternative, the geometric support of the second shoulder 25 is cylindrical around an axis parallel to the axis D and distant from the axis D.

In another alternative, the geometric support of the second shoulder 25 is conical around an axis parallel to the axis D and distant from the axis D.

More particularly, the geometric support of the third shoulder 30 is of revolution about the axis D. In one alternative, the geometric support of the third shoulder 30 is cylindrical around the axis D. In another alternative, the geometric support of the third shoulder 30 is conical around the axis D.

The invention also relates to an adjustable display mechanism 50, including at least one such mobile component 10.

The invention also relates to an horological movement 100 including at least one such adjustable display mechanism 50, and/or at least one such mobile component 10.

The invention also relates to a timepiece 1000, in particular a watch, including at least one such horological movement 100, and/or at least one such adjustable display mechanism 50, and/or at least one such mobile component 10.

Figure 6:
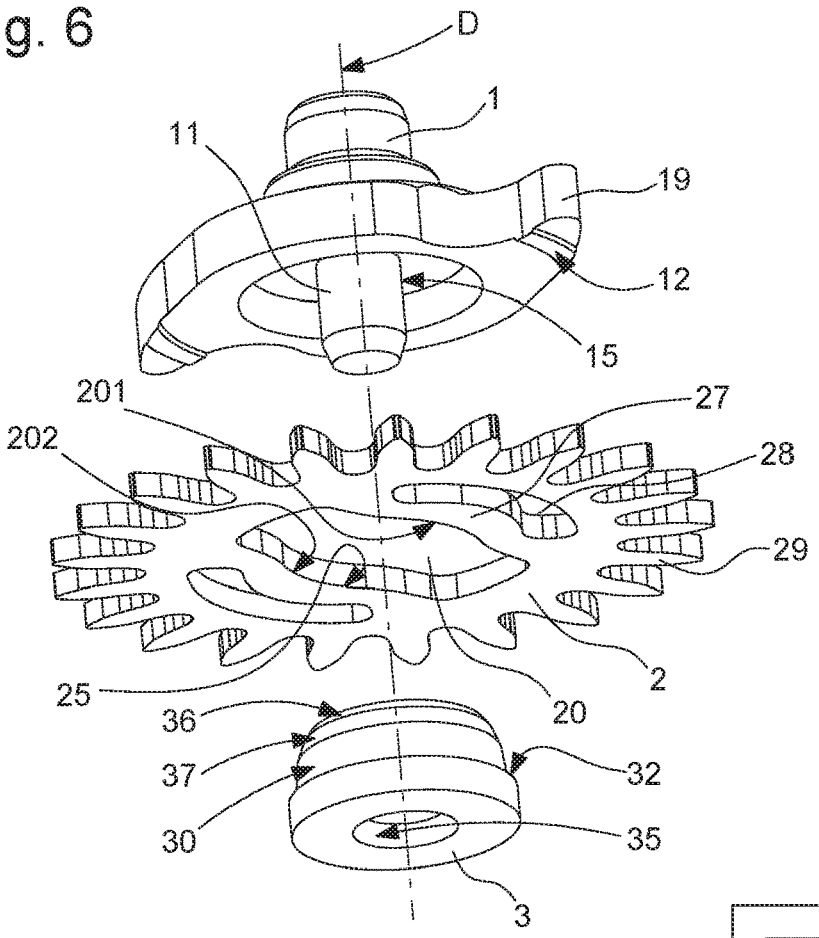
FIG. 6 shows, in a schematised manner and in an exploded perspective, the horological mobile component of FIGS. 1, 2 and 3, with an ascending axial arrow showing the pre-mounting of the second element with the third element.
Figure 8:
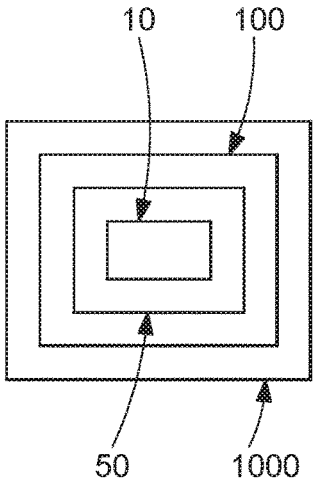
FIG. 8 is a block diagram that shows a timepiece, in particular a watch, including an horological movement which itself includes an adjustable display mechanism including an horological mobile component according to the invention.
Figure 7:
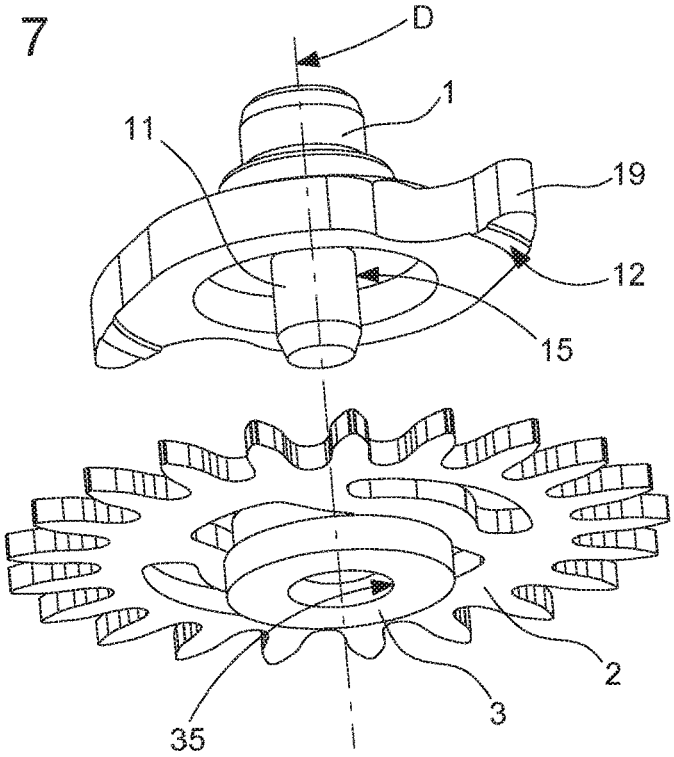
FIG. 7 shows, in a manner similar to FIG. 6, the end of the assembly of this mobile component, with an ascending axial arrow showing the mounting of the subassembly, consisting of the second element and the third element, onto the trunnion of the first element.

The invention is well adapted for an optimal mounting for small dimensions (clean insertion, limitation of burr and of deformation). The drawings illustrate the non-limiting case in which the second element 2 is a plate, which cooperates with a tube constituting the third element 3. The pre-mounting of the plate on the tube is carried out by successively performing the operations according to FIGS. 6 and 7, in this order. FIG. 6 shows the pre-mounting of the second element 2 with the third element 3, with friction bearing. According to the geometries chosen for the second shoulder 25 and the third shoulder 30, this friction can be adjustable according to the value of the relative axial penetration between the second element 2 and the third element 3. FIG. 7 shows the end of the assembly of this mobile component, with an ascending axial arrow showing the mounting of the subassembly, consisting of the second element 2 and the third element 3, onto the trunnion 11 of the first element 1. According to the geometries chosen for the fourth shoulder 35 and the first shoulder 15, a secondary friction can be disposed, or not, between the first element 1 and the third element 3.

In the particular and non-limiting case illustrated by the drawings:

- the third element 3 includes a cone for progressive insertion with a first insertion slope 36 having a half cone angle of between 25° and 40°, and a second slope 37, and/or a conical shoulder 39 with a last insertion slope having a half cone angle of between 10° and 25°;

the gripping between the second element 2 (in particular a plate) and the third element 3 (in particular a tube) is comprised in a range of 0.04-0.10 mm for a functional torque range of 0.10-0.50N·cm;

in addition to a more stable friction, the flexible arms 27 allow to minimise the deformation in the plane perpendicular to the axis D (radial beat);

the gripping of the third element 3 (in particular a tube made of steel) on the trunnion 11 of the first element 1 (in particular an arbor made of steel) has a minimum value of 0.002 mm to ensure an axial and a torque resistance. In the case in which this resistance (axial and/or torque) is insufficient, a welding between them is possible, in particular by laser spot welding, or other;

in a particular alternative, the second element 2 and the third element 3 are made of steel;

the choice of a third element 3 made of steel is advantageous for reasons of resistance on a trunnion 11 made of steel, and also to limit its deformation upon driving (a swelling of the component would have a direct influence on the friction since it is in contact with the second element 2);

the choice of a second element 2 cut, or stamped, or other, from steel allows to obtain mechanical characteristics advantageous for this type of use with friction;

in one alternative with two points of contact, the second element 2 is advantageously symmetrical to allow a maximum active length of the flexible arms. It is advantageous to provide safeties of walls of material in the (radial) side of a minimum of 0.15 mm; this is well compatible with the manufacturing constraints upon cutting/stamping and during the cutting of the toothing if necessary.

In short, in an horological adjustment mechanism, it is generally difficult to manage the control of a friction, in particular for small dimensions (in span, and thickness in particular), the control of a friction is difficult to manage, in particular because of the deformations. The invention provides a good response to this management of a friction via the addition, between the two components between which a relative adjustment must be carried out (the first element 1 and the second element 2), of an intermediate component, here the third element 3, which can be made with a low cost, for example in the form of a profile-turned part. The functional diameter of friction can be easily adapted, or even allow a pairing of parts.

The choice of an alternative with an angle of insertion at an insertion surface 36 on the third element 3 simplifies the mounting of the second element 2, in particular of a plate, on this third element 3, with a more progressive insertion, a reduced deformation, and less risk of a burr, the functional diameter remaining unchanged, while guaranteeing an axial maintaining of the second element 2 after mounting.

Figure 4:
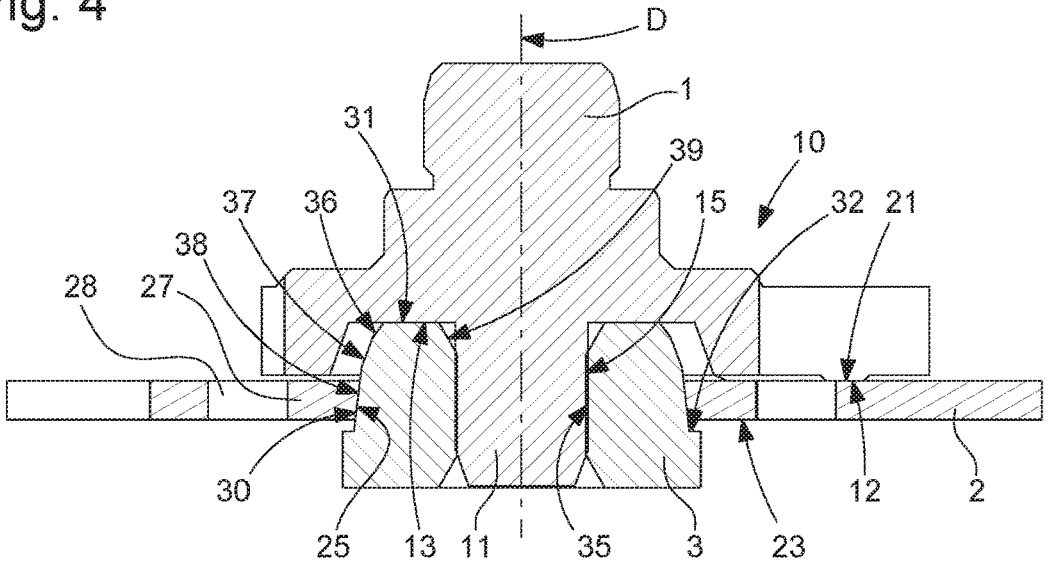
Figure 5:
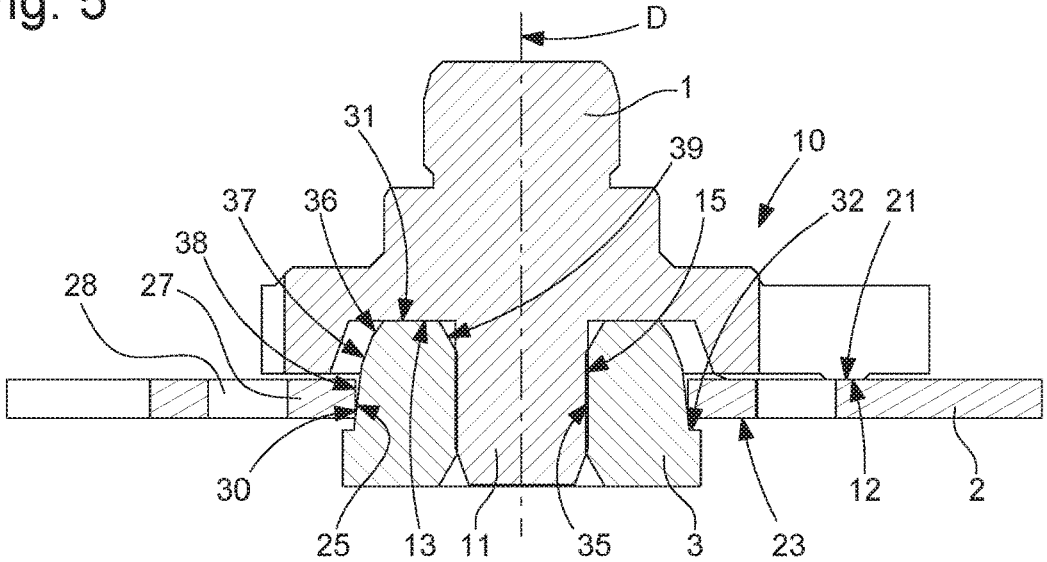

In another embodiment, corresponding to FIG. 4 or 5, a third shoulder 30 with a conical functional surface allows a fine adjustment of the friction, with a variable friction value according to the driving height.

In short, the invention allows a proper management of the friction: low dispersion, possibility of pairing and of fine adjustment; adjustable friction according to the alternative.

The invention claimed is:

1. A horological mobile component with an element maintained by friction, comprising a first element including a first shoulder around an axis, and a second element including a second shoulder around said axis, wherein said second shoulder of said second element cooperates by friction with a third shoulder that is included, around said axis, by a third element interposed between said first element and said second element, which said third element includes a fourth shoulder which cooperates by friction with said first shoulder or which is fastened onto said first shoulder, and wherein the minimum bearing diameter, with respect to said axis, of said third shoulder is at least double the maximum bearing diameter of said fourth shoulder, wherein said second element includes a main hollow defining at least two bearing surfaces each including one or two bearing sectors belonging to said second shoulder.

2. The mobile component according to claim 1, wherein said fourth shoulder cooperates by friction with said first shoulder.

3. The mobile component according to claim 2, wherein the friction torque between said fourth shoulder and said first shoulder is greater than the friction torque between said second shoulder and said third shoulder.

4. The mobile component according to claim 1, wherein said fourth shoulder is driven onto said first shoulder.

5. The mobile component according to claim 4, wherein said fourth shoulder is stopped on said first shoulder by at least one weld point.

6. The mobile component according to claim 1, wherein said first element comprises a first stop bearing surface arranged to cooperate via axial stop bearing, according to the direction of said axis, with a second stop bearing surface that said second element includes.

7. The mobile component according to claim 1, wherein said first element comprises an inner stop bearing surface arranged to cooperate via axial stop bearing, according to the direction of said axis, with a complementary inner stop bearing surface that said third element includes.

8. The mobile component according to claim 1, wherein said third element comprises an outer stop bearing surface arranged to cooperate with a complementary outer stop bearing surface that said second element includes to limit their relative axial travel according to the direction of said axis.

9. The mobile component according to claim 1, wherein said first element comprises at least first drive means, and wherein said second element includes at least second drive means.

10. The mobile component according to claim 1, wherein said main hollow defines two bearing surfaces each including two bearing sectors belonging to said second shoulder, and wherein said main hollow is countersunk between said bearing sectors, for a bearing limited to four points between said first element and said second element.

11. The mobile component according to claim 1, wherein said second element exerts a friction on said third element by flexible arms disposed between said main hollow and secondary hollows.

12. The mobile component according to claim 1, wherein said third element comprises at least one conical or spherical insertion surface for its insertion onto said first element or into said second element.

13. The mobile component according to claim 1, wherein said fourth shoulder and said first shoulder are of revolution about said axis.

14. The mobile component according to claim 13, wherein said fourth shoulder and said first shoulder are cylindrical around said axis.

15. The mobile component according to claim 1, wherein the geometric support of said second shoulder is cylindrical around an axis parallel to said axis and distant from said axis.

16. The mobile component according to claim 1, wherein the geometric support of said second shoulder is conical around an axis parallel to said axis and distant from said axis.

17. The mobile component according to claim 1, wherein the geometric support of said third shoulder is of revolution about said axis.

18. The mobile component according to claim 17, wherein the geometric support of said third shoulder is cylindrical around said axis.

19. The mobile component according to claim 17, wherein the geometric support of said third shoulder is conical around said axis.

20. The mobile component according to claim 19, wherein said third element comprises an outer stop bearing surface arranged to cooperate with a complementary outer stop bearing surface that said second element includes to limit their relative axial travel according to the direction of said axis, and wherein the space between said outer stop bearing surface and said complementary outer stop bearing surface is arranged to allow the introduction of a thickness gauge to adjust the value of the gripping between said third element and said second element and thus the value of the friction exerted by said second element on said third element.

21. An adjustable display mechanism, comprising at least one mobile component according to claim 1.

22. A horological movement comprising at least one such adjustable display mechanism including at least one mobile component according to claim 1.

23. A timepiece comprising at least one horological movement comprising at least one such adjustable display mechanism including at least one mobile component according to claim 1.

* * * * *